US008434164B2

(12) United States Patent
Clark

(10) Patent No.: US 8,434,164 B2
(45) Date of Patent: May 7, 2013

(54) MESSAGE-CONVEYING INTERLOCKING ATHLETIC GLOVES

(75) Inventor: Timothy A. Clark, Durham, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/326,121

(22) Filed: Dec. 14, 2011

(65) Prior Publication Data

US 2012/0073029 A1 Mar. 29, 2012

Related U.S. Application Data

(63) Continuation of application No. 12/787,213, filed on May 25, 2010.

(51) Int. Cl.
*A41D 19/00* (2006.01)

(52) U.S. Cl.
USPC ..... 2/161.1; 2/161.3

(58) Field of Classification Search ..... 2/158, 159, 2/160, 161.1, 161.2, 161.3, 161.5, 161.6, 2/161.7, 161.8; D2/610, 613, 615, 617, 618, D2/619, 621, 622
See application file for complete search history.

(56) References Cited

U.S. PATENT DOCUMENTS

| | | | | | |
|---|---|---|---|---|---|
| D61,481 | S | | 1/1922 | Rice | |
| D61,479 | S | * | 9/1922 | Rice | D2/623 |
| D61,482 | S | * | 9/1922 | Rice | D2/623 |
| 1,624,429 | A | | 4/1927 | Palmer | |
| 1,630,730 | A | | 5/1927 | Daugherty | |
| D100,283 | S | * | 7/1936 | Ovenden | D2/615 |
| D113,363 | S | | 2/1939 | Ireland | |
| D114,680 | S | * | 5/1939 | Henderson | D2/615 |
| D124,692 | S | * | 1/1941 | Ginsberg | D2/619 |
| D131,053 | S | * | 1/1942 | Stall | D2/615 |
| D132,564 | S | * | 5/1942 | Lindfelt | D2/622 |
| RE22,167 | E | | 8/1942 | Wells | |
| D161,882 | S | * | 2/1951 | Sperandeo | D2/615 |
| D161,988 | S | * | 2/1951 | Adams | D2/615 |
| 2,546,209 | A | * | 3/1951 | Baum | 446/327 |

(Continued)

FOREIGN PATENT DOCUMENTS

DE 29717381 U1 * 1/1998

OTHER PUBLICATIONS

Internet article from Yard Barker, "Nike Pro-Combat, The Complete Collection With Slogans!" dated Nov. 10, 2009, http://friendsoftheprogram.net/2009/11/10/nike-pro-combat-the-complete-collection-with-slogans/; 44 pages.
Office Action of Dec. 30, 2011 for U.S. Appl. No. 12/787,213.

(Continued)

*Primary Examiner* — Khoa Huynh
*Assistant Examiner* — Brieanna Fuller
(74) *Attorney, Agent, or Firm* — Shook, Hardy & Bacon L.L.P.

(57) ABSTRACT

A message-conveying athletic glove with enhanced gripping is provided. The glove comprises a palm-side portion and a back portion connected to form four finger sheaths, a thumb sheath, and an opening capable of receiving a human hand. A first image portion of a complete image is located on one or more of the palm-side portion or the back portion of the glove. When the glove is worn by the user and interlocks with a second glove having a second image portion of the complete image displayed, the complete image is displayed by the interlocked gloves, conveying a message. The palm-side portion of the glove is made of a material to enhance gripping.

11 Claims, 8 Drawing Sheets

U.S. PATENT DOCUMENTS

| | | | | | |
|---|---|---|---|---|---|
| D167,397 | S | * | 8/1952 | Fare | D2/616 |
| D168,944 | S | * | 3/1953 | Levene | D2/616 |
| 2,729,023 | A | | 1/1956 | Lerner | |
| D177,692 | S | | 5/1956 | O'Brien | |
| D179,965 | S | * | 4/1957 | Dannenberg | D2/615 |
| D189,637 | S | | 1/1961 | Stanton | |
| 3,096,523 | A | | 7/1963 | Bruchas | |
| 3,258,858 | A | | 7/1966 | Cariffe | |
| D270,681 | S | * | 9/1983 | Banks | D2/615 |
| D282,981 | S | * | 3/1986 | Pierce | D2/615 |
| 5,036,550 | A | * | 8/1991 | Wilsey | 2/144 |
| 5,084,915 | A | | 2/1992 | Shotwelkl et al. | |
| 5,086,516 | A | | 2/1992 | Baxter | |
| D331,834 | S | | 12/1992 | Wallace | |
| D335,024 | S | | 4/1993 | Moffitt | |
| 5,433,025 | A | | 7/1995 | Borghese | |
| 5,467,484 | A | | 11/1995 | Drescher | |
| 5,500,956 | A | | 3/1996 | Schulkin | |
| D369,309 | S | | 4/1996 | Marbach | |
| 5,571,020 | A | | 11/1996 | Troudet | |
| 5,586,888 | A | | 12/1996 | Webb | |
| 5,881,384 | A | | 3/1999 | Williams | |
| 5,926,847 | A | | 7/1999 | Elbert | |
| 6,108,817 | A | | 8/2000 | Kostelac | |
| 6,142,785 | A | | 11/2000 | Williams | |
| 6,209,138 | B1 | | 4/2001 | Kang | |
| 6,216,276 | B1 | | 4/2001 | Elbert | |
| D449,423 | S | | 10/2001 | Lowsky | |
| 6,308,331 | B1 | | 10/2001 | Robak | |
| 6,324,696 | B1 | | 12/2001 | Montgomery | |
| 6,405,381 | B1 | | 6/2002 | Bowman, Jr. | |
| 6,408,442 | B1 | | 6/2002 | Kang | |
| 6,612,056 | B1 | | 9/2003 | Thomas, II | |
| 6,625,816 | B1 | * | 9/2003 | Cooke | 2/161.5 |
| 6,761,355 | B1 | | 7/2004 | Lemieux | |
| 6,912,731 | B2 | | 7/2005 | Cass | |
| 6,990,689 | B1 | | 1/2006 | Thellmann | |
| 7,152,249 | B2 | * | 12/2006 | Geng | 2/161.6 |
| D552,801 | S | | 10/2007 | Van Trojen | |
| 7,310,830 | B2 | | 12/2007 | Kuharcik | |
| 7,487,553 | B2 | | 2/2009 | Price | |
| D591,481 | S | * | 5/2009 | Raymond | D2/617 |
| D596,377 | S | * | 7/2009 | Butler | D2/615 |
| D609,428 | S | | 2/2010 | Bengyak | |
| D617,976 | S | | 6/2010 | Bengyak | |
| D618,431 | S | | 6/2010 | Bengyak | |
| D618,432 | S | | 6/2010 | Bengyak | |
| D625,897 | S | | 10/2010 | Bengyak | |
| D628,356 | S | | 12/2010 | Bengyak | |
| D628,357 | S | | 12/2010 | Bengyak | |
| D628,358 | S | | 12/2010 | Bengyak | |
| D628,767 | S | | 12/2010 | Bengyak | |
| D631,227 | S | | 1/2011 | Bengyak | |
| D631,637 | S | | 2/2011 | Bengyak | |
| D632,869 | S | | 2/2011 | Bengyak | |
| 7,895,774 | B2 | | 3/2011 | Pawsey | |
| D635,736 | S | | 4/2011 | Warman | |
| D636,557 | S | | 4/2011 | Bengyak | |
| D640,447 | S | | 6/2011 | Bengyak | |
| D640,857 | S | | 7/2011 | Bengyak | |
| 2002/0020082 | A1 | | 2/2002 | James | |
| 2003/0126666 | A1 | * | 7/2003 | McNamara | 2/16 |
| 2003/0229931 | A1 | * | 12/2003 | Smedi | 2/159 |
| 2004/0244092 | A1 | * | 12/2004 | Peil | 2/169 |
| 2005/0155134 | A1 | | 7/2005 | McLin | |
| 2005/0223600 | A1 | | 10/2005 | Hunter et al. | |
| 2006/0200891 | A1 | * | 9/2006 | Geraci | 2/158 |
| 2006/0219693 | A1 | | 10/2006 | Earls et al. | |
| 2007/0250982 | A1 | * | 11/2007 | Norman | 2/69 |
| 2007/0256213 | A1 | | 11/2007 | Dunavin | |
| 2008/0263920 | A1 | | 10/2008 | Trigg et al. | |
| 2008/0295219 | A1 | | 12/2008 | Anderson | |
| 2009/0100572 | A1 | | 4/2009 | Jones | |
| 2010/0018093 | A1 | | 1/2010 | O'Sullivan | |
| 2010/0077526 | A1 | | 4/2010 | Smeltzer | |
| 2010/0229279 | A1 | * | 9/2010 | Martinez | 2/125 |
| 2011/0041235 | A1 | | 2/2011 | Harris | |
| 2011/0289651 | A1 | | 12/2011 | Clark | |

OTHER PUBLICATIONS

"Nike Pro-Combat, The Complete Collection With Slogans!" http://friendsoftheprogram.net/2009/11/10/nike-pro-combat-the-complete-collection-with-slogans/ (Nov. 10, 2009).

An article entitled "Joaquin Phoenix's Finger Message: "Good Bye!"" Huffington Post, Nov. 3, 2008, Retrieved from the Internet: <http://www.huffingtonpost.com/2008/11/03/joaquin-phoenixs-finger-m_n_140347.html>; 3 pages.

Non-Final Office Action mailed Dec. 30, 2011 regarding U.S. Appl. No. 12/787,213, 33 pages.

* cited by examiner

MESSAGE-CONVEYING INTERLOCKING ATHLETIC GLOVES

CROSS-REFERENCE TO RELATED APPLICATIONS

This application is a continuation of co-pending U.S. patent application Ser. No. 12/787,213, filed May 25, 2010 and titled "Message-Conveying Interlocking Athletic Gloves," the disclosure of which is hereby incorporated herein in its entirety by reference.

STATEMENT REGARDING FEDERALLY SPONSORED RESEARCH OR DEVELOPMENT

Not applicable.

TECHNICAL FIELD

The present invention relates to athletic gloves. More particularly, the present invention relates to a pair of athletic gloves, each glove having a portion of a complete image. When the gloves are interlocked, the gloves convey a message by forming the complete image.

BACKGROUND

Both professional and amateur athletes often wear athletic gloves to enhance gripping. In football, for example, wide receivers, tight ends, running backs, and others whose performance depends upon the ability to effectively grip the football often wear gloves to enhance their grip on the football. Conventional athletic gloves do not typically perform other functions in addition to enhancing grip.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Embodiments of the present invention relate to an athletic glove that conveys a message. The glove comprises a palm-side portion and a back portion. The back portion is connected to the palm-side portion to form four finger sheaths, a thumb sheath, and an opening capable of receiving a human hand. The opening is located opposite the four finger sheaths and corresponds approximately to the wrist of a user when the glove is worn by the user with fingers of the user extending within the four finger sheaths and the thumb of the user extending within the thumb sheath. The glove also comprises a first image portion of a complete image displayed on one or more of the palm-side portion or the back portion. When the glove is worn by the user and interlocks with a second glove having a second image portion displayed, the complete image is displayed by the interlocked gloves, conveying a message.

BRIEF DESCRIPTION OF THE DRAWINGS

The present invention is described in detail below with reference to the attached drawing figures, wherein.

DETAILED DESCRIPTION

Figure 1:
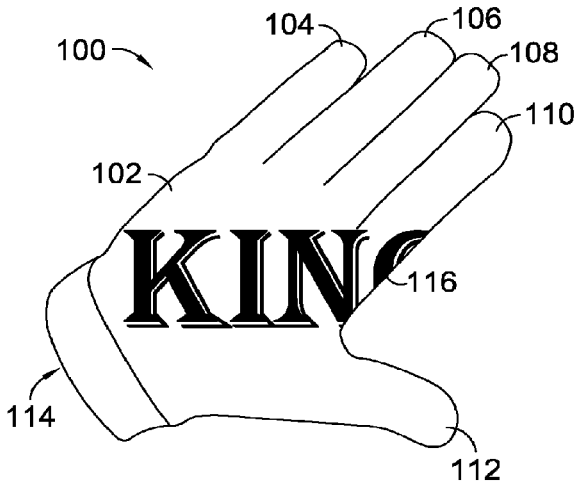
FIG. 1 is a perspective view of an exemplary embodiment of a message-conveying athletic glove showing a portion of a complete image of a team name.

Referring now to FIG. 1, an athletic glove 100 capable of receiving a human hand is shown. Glove 100 comprises a back portion (not shown) and a palm-side portion 102. Palm-side portion 102 and the back portion are connected to form four finger sheaths 104, 106, 108, and 110, a thumb sheath 112, and an opening 114 capable of receiving a human hand. Gussets or other additional pieces of material may bridge between the back portion and palm-side portion 102 to form glove 100. Opening 114 is located opposite finger sheaths 104, 106, 108, and 110 and corresponds approximately to the wrist of a user when the glove is worn by the user with fingers of the user extending within finger sheaths 104, 106, 108, and 110 and the thumb of the user extending within thumb sheath 112.

When the glove is worn in this manner, the back portion corresponds to the back of the user's hand, and palm-side portion 102 corresponds to the palm of the user's hand. In some embodiments, palm-side portion 102 is made in part or completely of a gripping material. The gripping material may be a synthetic leather, plastic, rubber, or other material. The gripping material may be a coating applied to an underlying material of which palm-side portion 102 is made. In some embodiments, glove 100 is a football glove such as a wide receiver's glove.

Figure 2:
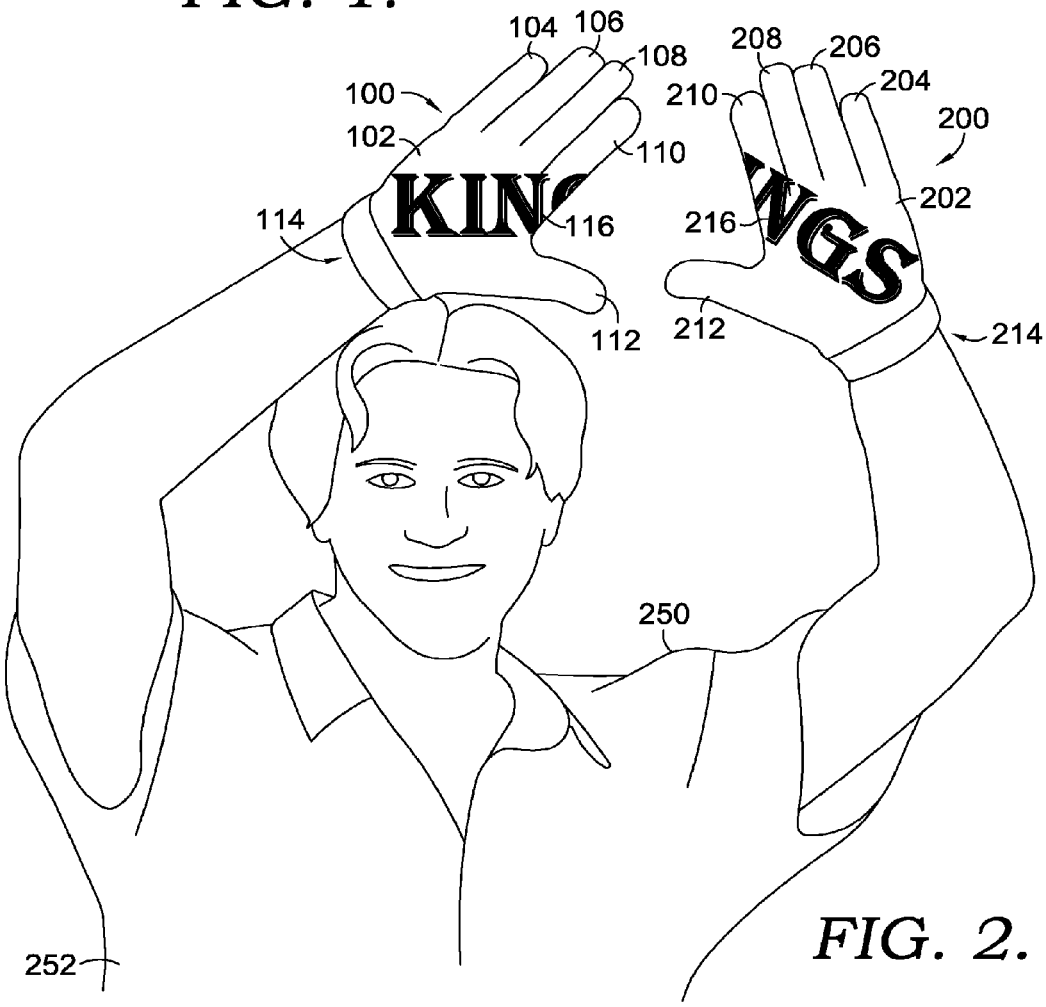
FIG. 2 is a perspective view of an exemplary embodiment of a pair of message-conveying athletic gloves worn by a user, each glove showing a portion of a complete image of a team name.
Figure 3:
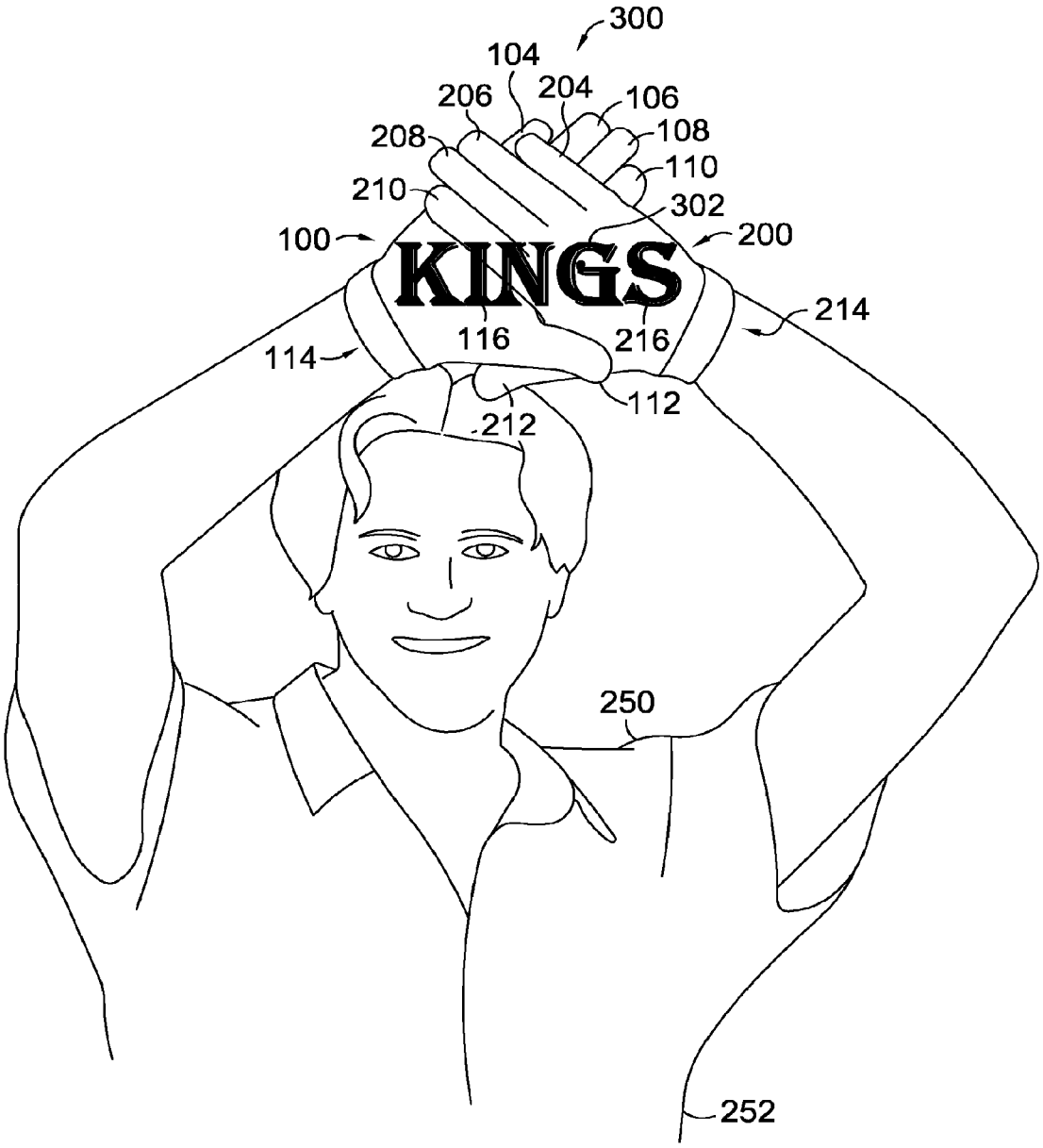
FIG. 3 is a perspective view of an exemplary embodiment of a pair of interlocked message-conveying athletic gloves worn by a user, each glove showing a portion of a complete image of a team name such that the complete team name is shown when the gloves are interlocked.

A first image portion 116 of a complete image (shown in FIG. 3) is displayed on palm-side portion 102. In some embodiments, first image portion 116 extends to the back portion of glove 100. First image portion 116 may be partially located on one or more of finger sheaths 104, 106, 108, and 110 and/or thumb sheath 112. First image portion 116 is a portion of a complete image of a logo of an athletic team called the "KINGS," as shown in FIG. 3. As used herein, "logo" can include any team name, nickname, mascot, symbol, icon, team city, or other symbol or word associated with an athletic team. In some embodiments, the complete image includes both a team name and mascot or symbol. Glove 100 is interlockable with a second glove having a second image portion displayed, as shown in FIGS. 2-3. When interlocked, glove 100 and the second glove together convey the message of the complete image. In FIGS. 1-3, the image is the athletic team name "KINGS."

FIG. 2 illustrates two athletic gloves, glove 100 as described in FIG. 1 and glove 200, gloves 100 and 200 being worn together as a pair by user 250. Glove 100 is a right-hand glove, and glove 200 is a left-hand glove. Like glove 100, glove 200 comprises a back portion (not shown) and a palm-side portion 202. Palm-side portion 202 and the back portion are connected to form four finger sheaths 204, 206, 208, and 210, a thumb sheath 212, and an opening 214 capable of receiving a human hand. Opening 214 is located opposite finger sheaths 204, 206, 208, and 210 and corresponds approximately to the wrist of user 250 when the glove is worn by user 250 with fingers of user 250 extending within finger sheaths 204, 206, 208, and 210 and the thumb of user 250 extending within thumb sheath 212.

A second image portion 216 of a complete image (shown in FIG. 3) is displayed on palm-side portion 202. In some embodiments, second image portion 216 extends to the back portion of glove 200. Second image portion 216 may be partially located on one or more of finger sheaths 204, 206, 208, and 210 and/or thumb sheath 212. Second image portion 216 is a portion of a complete image of a logo of an athletic team called the "KINGS," as shown in FIG. 3.

As discussed above, glove 100 is a right-hand glove, and glove 200 is a left-hand glove. FIG. 2 illustrates gloves 100 and 200 as worn by user 250 on the appropriate hands with the hands of user 250 substantially parallel to the torso 252 of user 250. The hands of user 250 are in an "open" position such that the fingers of user 250 are substantially straight. Palm-side portions 102 and 202 face away from user 250. When interlocked, gloves 100 and 200 together convey the message of the complete image (shown in FIG. 3.). The message is easily viewable to other people facing user 250.

Figure 4:
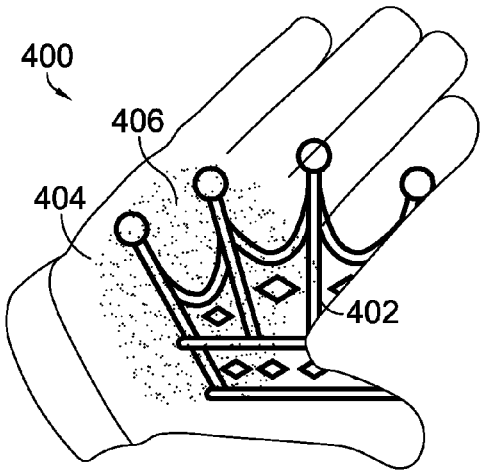
FIG. 4 is a perspective view of an exemplary embodiment of a message-conveying athletic glove showing a portion of a complete image of a team logo.
Figure 5:
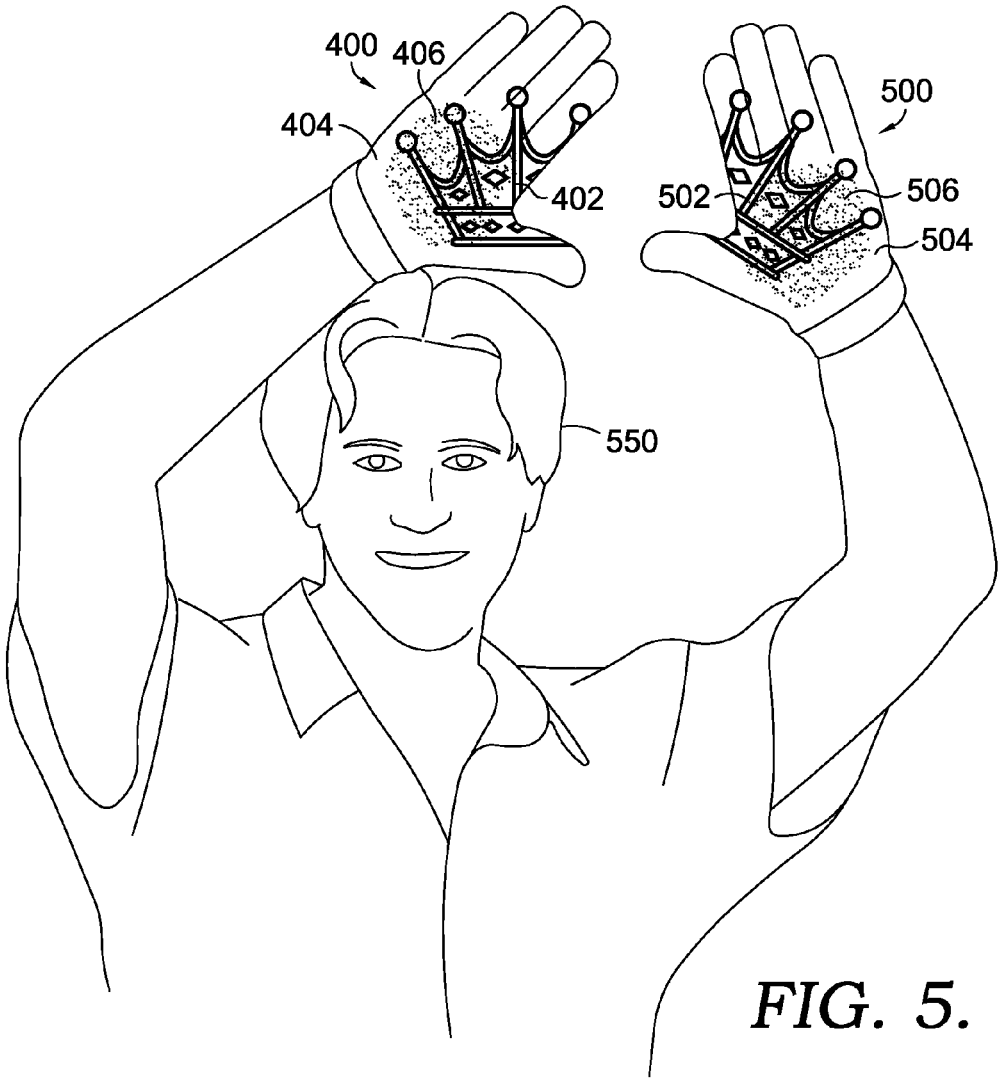
FIG. 5 is a perspective view of an exemplary embodiment of a pair of message-conveying athletic gloves worn by a user, each glove showing a portion of a complete image of a team logo.
Figure 6:
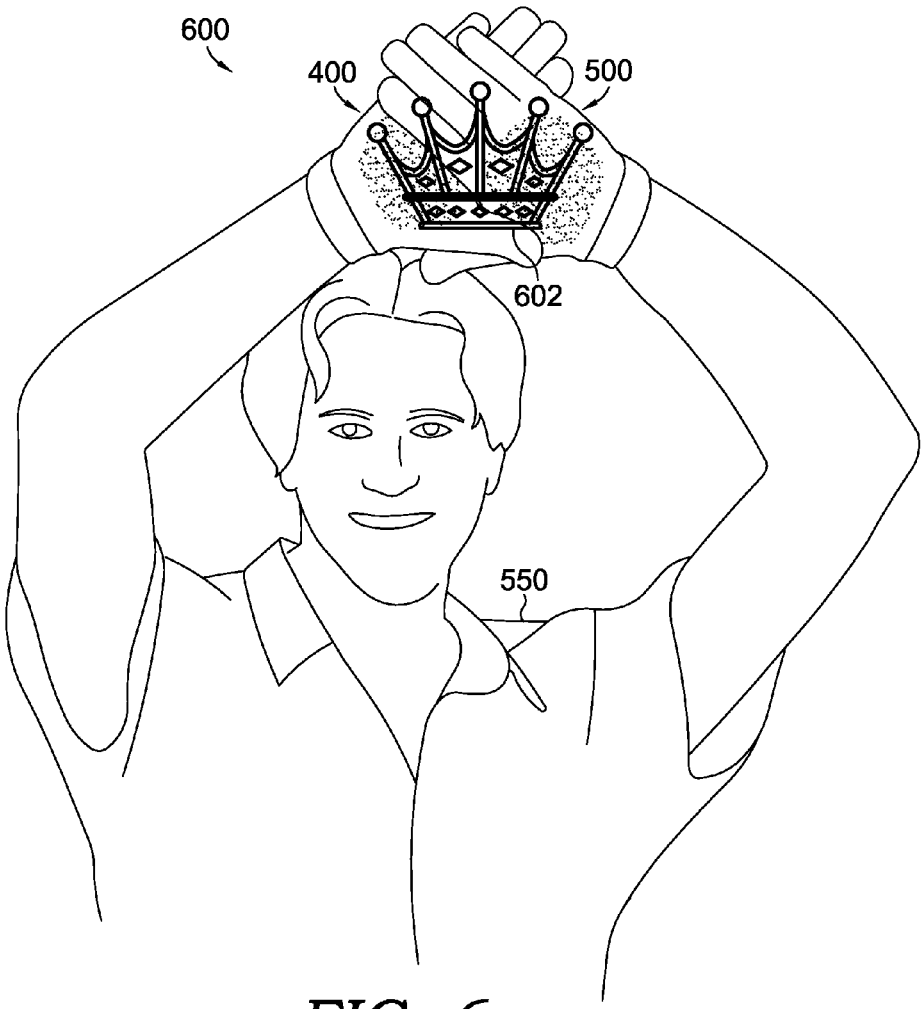
FIG. 6 is a perspective view of an exemplary embodiment of a pair of interlocked message-conveying athletic gloves worn by a user, each glove showing a portion of a complete image of a team logo such that the complete team logo is shown when the gloves are interlocked.

FIG. 3 illustrates an interlocked pair of gloves 300 comprising gloves 100 and 200 interlocked by user 250 wearing gloves 100 and 200 as described in FIG. 2. Interlocked pair of gloves 300 displays complete image 302. Complete image 302 is a logo of an athletic team called the "KINGS." Complete image 302 is a team name, but, as discussed above, complete image 302 can be any number of words, symbols, or objects associated with an athletic team. FIGS. 4-6 illustrate embodiments where the logo is a symbol. First image portion 116 and second image portion 216 of FIGS. 2 and 3 are designed such that when the gloves interlock, first image portion 116 and second image portion 216 form complete image 302.

In some embodiments, this design is accomplished by including more than half of complete image 302 in each of first image portion 116 and second image portion 216 such that gloves 100 and 200 are overlappingly interlocked until complete image 302 is properly formed and displayed. Gloves 100 and 200 are overlappingly interlocked such that, from the point of view of a person viewing complete image 302, thumb portion 112 of glove 100 is placed in front of thumb portion 212 of glove 200, and finger sheaths 204, 206, 208, and 210 of glove 200 are placed in front of finger sheaths 104, 106, 108, and 110 of glove 100.

First image portion 116 and second image portion 216 may be designed so that complete image 302 is also formed when thumb portion 212 of glove 200 is placed in front of thumb portion 112 of glove 100, and finger sheaths 104, 106, 108, and 110 of glove 100 are placed in front of finger sheaths 204, 206, 208, and 210 of glove 200. In some embodiments, the design of first image portion 116 and second image portion 216 allows complete image 302 to be displayed using both of the above overlapping configurations. In other embodiments, approximately half of complete image 302 is included in first image portion 116 and half in second image portion 216.

FIGS. 4-9 illustrate a message-conveying athletic glove where the displayed complete image is an athletic team symbol or mascot—in this example, the complete image is a "crown" symbol for the "KINGS" athletic team.

FIG. 4 shows an exemplary athletic glove 400. Athletic glove 400 includes a first image portion 402, palm-side portion 404, and gripping material 406.

FIG. 5 shows user 550 wearing right-hand glove 400 and left-hand glove 500 prior to interlocking. First image portion 402 on palm-side portion 404 with gripping material 406 of glove 400 and second image portion 502 on palm-side portion 504 with gripping material 506 of glove 500 are each more than half of the complete image (crown) shown in FIG. 6. By interlocking gloves 400 and 500 as shown in FIG. 6, a message is conveyed to other people facing user 550.

FIG. 6 illustrates interlocked athletic glove pair 600, comprising right-hand glove 400 and left-hand glove 500. When interlocked as shown in FIG. 6, complete image 602 is displayed in a continuous and uninterrupted fashion.

Figure 7:
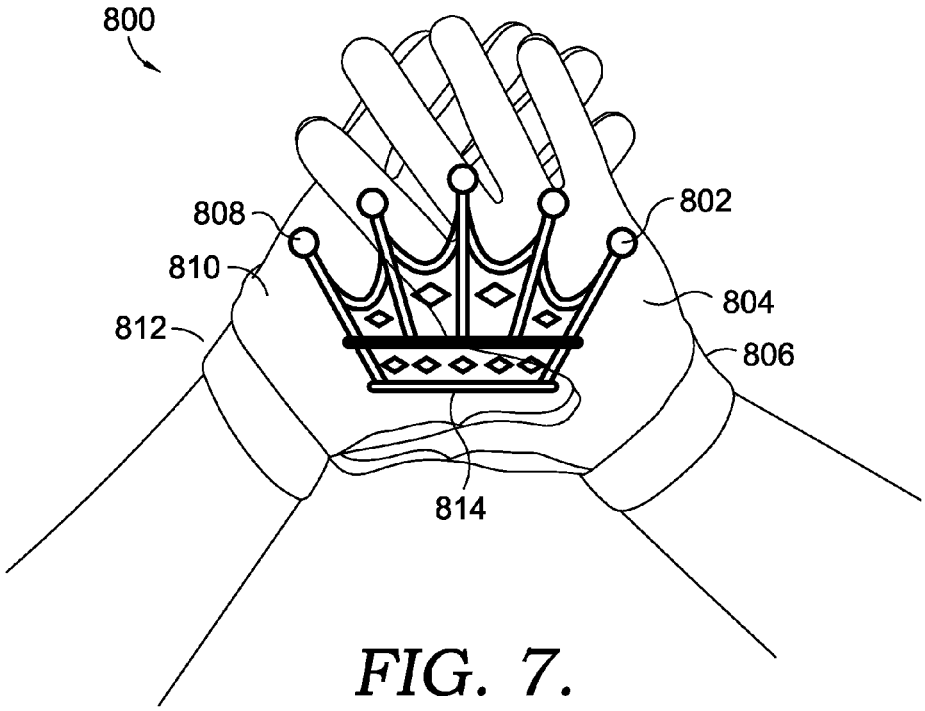
FIG. 7 is a perspective view that illustrates back portions of interlocked athletic glove pair with the complete image portion shown.

FIG. 7 illustrates back portions of interlocked athletic glove pair 800. First image portion 802 is on a back portion 804 of right-hand glove 806 and second image portion 808 is on a back portion 810 of left-hand glove 812. When gloves 806 and 812 are interlocked, as shown in FIG. 7, complete image 814 is formed.

Figure 8:
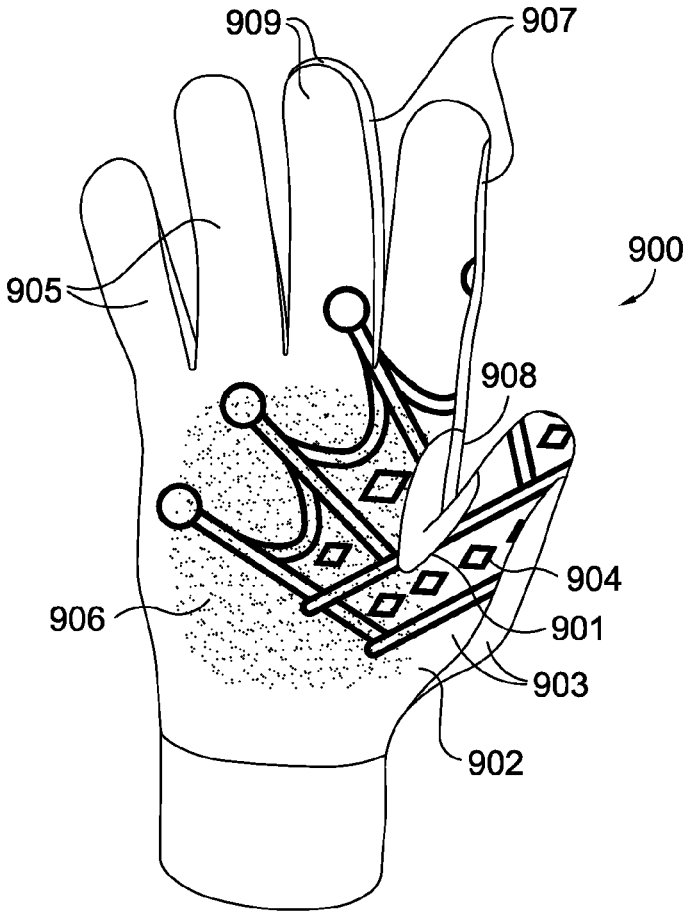
FIG. 8 is a perspective view that illustrates a palm-side portion with a first image portion, gripping material, and a gusset.
Figure 9:
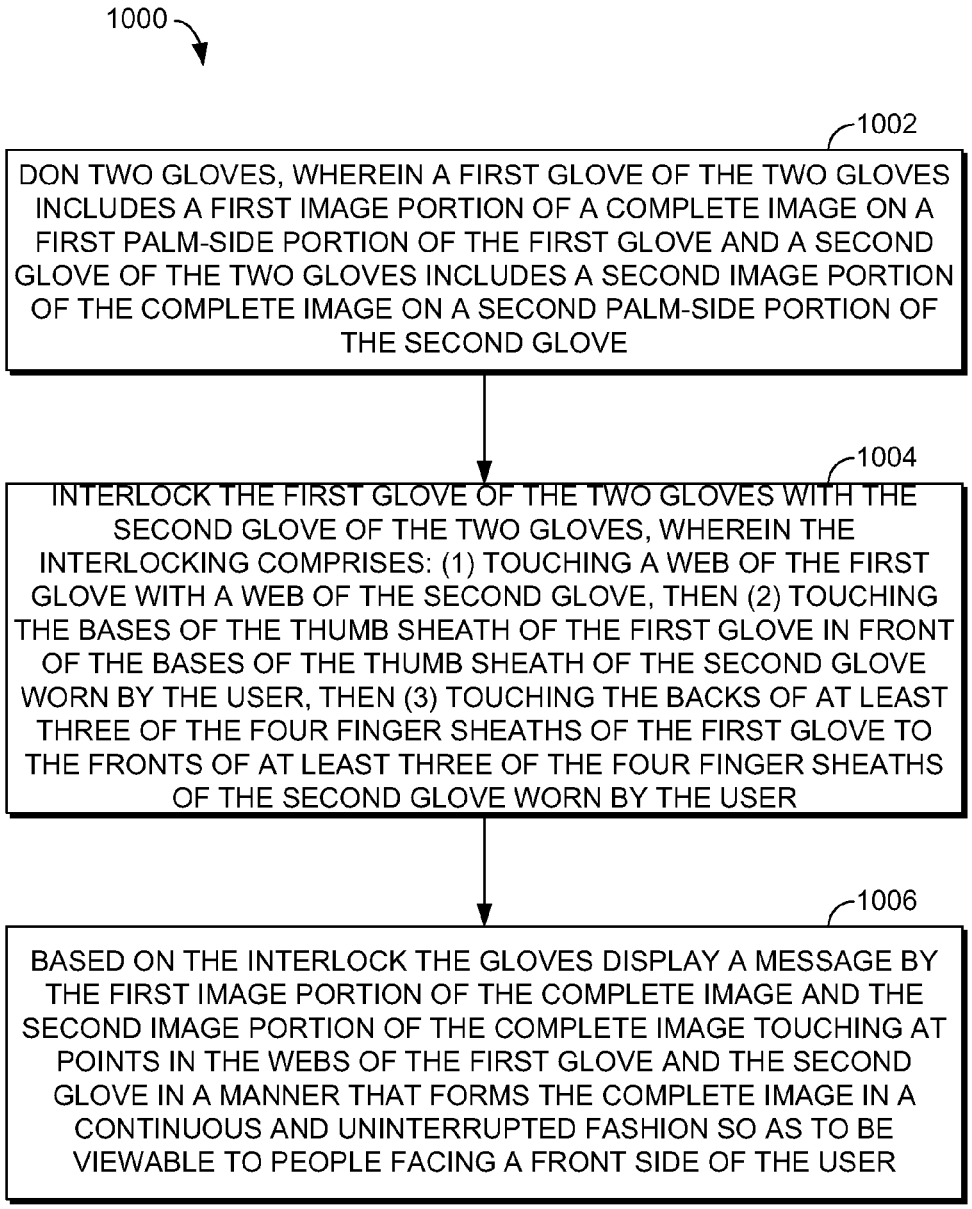
FIGS. 9-10 are method steps for conveying a message by an athletic glove by two gloves.
Figure 10:
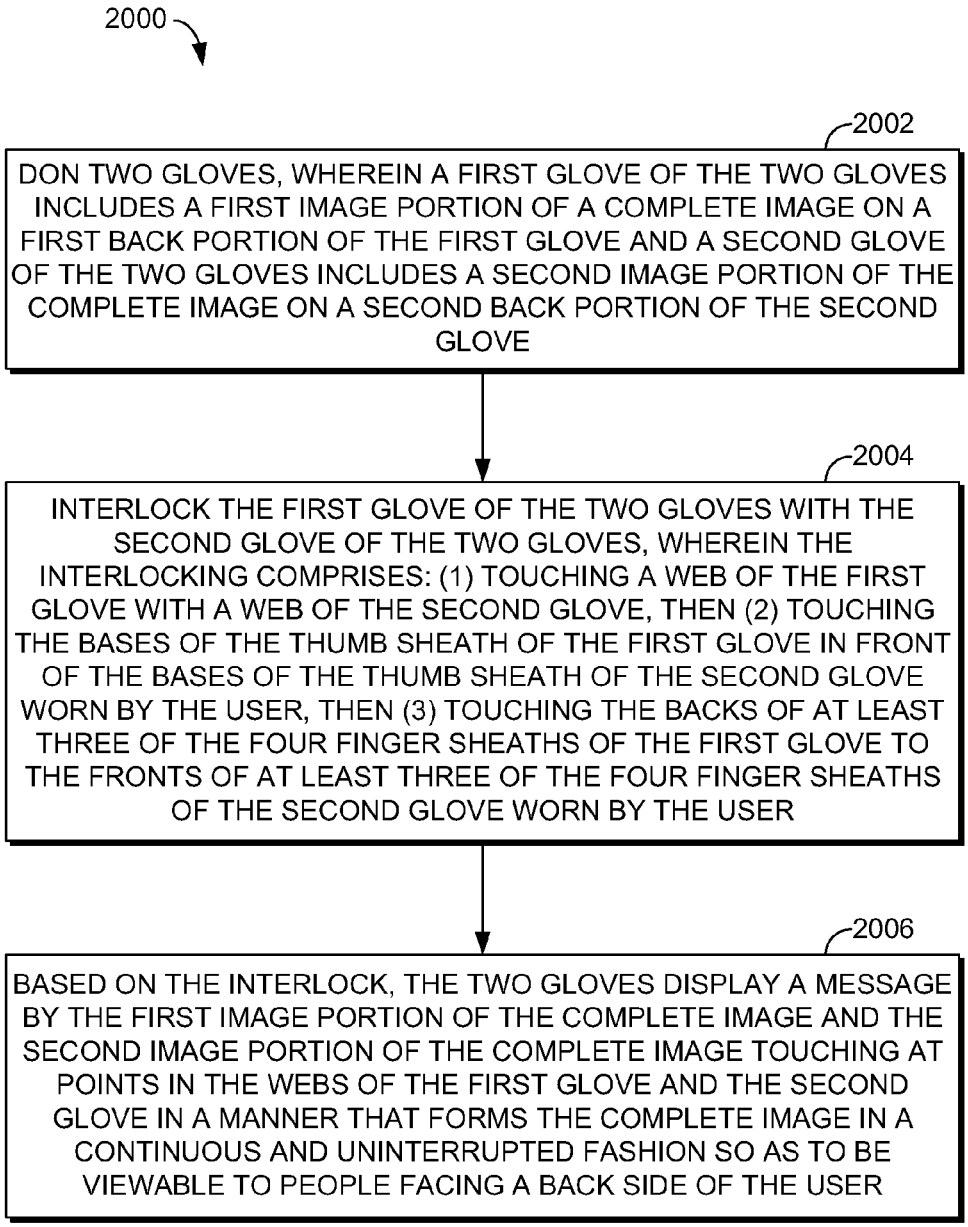

FIG. 8 shows athletic glove 900. FIG. 9 illustrates a palm-side portion 902 with a first image portion 904, gripping material 906 and a gusset 908. Additionally, athletic glove 900 illustrates a web area 901 of the glove, a base 903 of the thumb sheath, fronts 905 of the finger sheaths, backs 907 of the finger sheaths, and tips 909 of the finger sheaths.

Turning now to FIG. 9, a method 1000 for conveying a message by an athletic glove capable of receiving a human hand. In step 1002, a user dons two gloves. Each of the two gloves comprises a palm-side portion and a back portion. The back portion is connected to the palm-side portion to form four finger sheaths, a thumb sheath, and an opening capable of receiving a human hand. The first glove of the two gloves includes a first image portion of a complete image on a first palm-side portion of the first glove and a second glove of the two gloves includes a second image portion of the complete image on a second palm-side portion of the second glove. In step 1004, a user interlocks the two gloves. The interlocking comprises: (1) touching a web of the first glove with a web of the second glove, then (2) touching the bases of the thumb sheath of the first glove in front of the base of the thumb sheath of the second glove worn by the user, then (3) touching the backs of at least three of the four finger sheaths of the first glove to the fronts of at least three of the four finger sheaths of the second glove worn by the user. In step 1006, a user may display a message, based on the interlocked gloves, by the first image portion and the second image portion touching at points in webs of the first glove and the second glove in a manner that forms the complete image in a continuous and uninterrupted fashion so as to be viewable to people facing a front side of the user. Further, as used herein, a right-hand glove may be referred to as a first or second glove and a left-hand glove may also be referred to as a first or second glove.

In some embodiments the image portions may be located substantially on the back portions of the gloves, rather than on the palm-side portions as shown in FIGS. 1-6 such that the backs of a user's hands, rather than the palms of the user's hands display the complete image and convey the message.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Having thus described the invention, what is claimed is:

1. A method for conveying a message by an athletic glove capable of receiving a human hand, the method comprising:

donning two gloves, wherein each of the two gloves comprise a palm-side portion and a back portion, the back portion connected to the palm-side portion to form four finger sheaths, a thumb sheath, and an opening capable of receiving a human hand, the opening located opposite the four finger sheaths and corresponding approximately to the wrist of a user when said each of the two gloves are worn by the user with fingers of the user extending within the four finger sheaths and the thumb of the user extending within the thumb sheath, each of the four finger sheaths and the thumb sheath having fronts corresponding to the front of the user's hand, backs corresponding to the back of the user's hand, tips corresponding to the tips of the user's fingers and thumb, and bases corresponding to the bases of the user's fingers and thumb, wherein a first glove of the two gloves includes a first image portion of a complete image on a first palm-side portion of the first glove and a second glove of the two gloves includes a second image portion of the complete image on a second palm-side portion of the second glove, interlocking the first glove of the two gloves with the second glove of the two gloves, wherein the interlocking comprises: (1) touching a web of the first glove with a web of the second glove, then (2) touching the bases of the thumb sheath of the first glove in front of the bases of the thumb sheath of the second glove worn by the user, then (3) touching the backs of at least three of the four finger sheaths of the first glove to the fronts of at least three of the four finger sheaths of the second glove worn by the user; and based on the interlocking, the two gloves displaying a message by the first image portion of the complete image and the second image portion of the complete image touching at points in the webs of the first glove and the second glove in a manner that forms the complete image in a continuous and uninterrupted fashion so as to be viewable to people facing a front side of the user.

2. The method of claim 1, wherein the complete image is an athletic team name or city.

3. The method of claim 1, wherein the complete image is an athletic team logo or mascot.

4. The method of claim 1, wherein the athletic glove is a football glove.

5. The method of claim 1, wherein the first and second palm-side portions are made of a gripping material.

6. The method of claim 1, wherein the first image portion of the complete image is substantially on the first palm-side portion of the first glove.

7. A method for conveying a message by an athletic glove capable of receiving a human hand, the method comprising:

donning two gloves, wherein each of the two gloves comprise a palm-side portion and a back portion, the back portion connected to the palm-side portion to form four finger sheaths, a thumb sheath, and an opening capable of receiving a human hand, the opening located opposite the four finger sheaths and corresponding approximately to the wrist of a user when said each of the two gloves are worn by the user with fingers of the user extending within the four finger sheaths and the thumb of the user extending within the thumb sheath, each of the four finger sheaths and the thumb sheath having fronts corresponding to the front of the user's hand, backs corresponding to the back of the user's hand, tips corresponding to the tips of the user's fingers and thumb, and bases corresponding to the bases of the user's fingers and thumb, wherein a first glove of the two gloves includes a first image portion of a complete image on a first back portion of the first glove and a second glove of the two gloves includes a second image portion of the complete image on a second back portion of the second glove, interlocking the first glove of the two gloves with the second glove of the two gloves, wherein the interlocking comprises: (1) touching a web of the first glove with a web of the second glove, then (2) touching the bases of the thumb sheath of the first glove in front of the bases of the thumb sheath of the second glove worn by the user, then (3) touching the backs of at least three of the four finger sheaths of the first glove to the fronts of at least three of the four finger sheaths of the second glove worn by the user; and based on the interlocking, the two gloves displaying a message by the first image portion of the complete image and the second image portion of the complete image touching at points in the webs of the first glove and the second glove in a manner that forms the complete image in a continuous and uninterrupted fashion so as to be viewable to people facing a back side of the user.

8. The method of claim 7, wherein the complete image is an athletic team name or city.

9. The method of claim 7, wherein the complete image is an athletic team logo or mascot.

10. The method of claim 7, wherein the athletic glove is a football glove.

11. The method of claim 7, wherein the first image portion of the complete image is substantially on the first back portion of the first glove.

* * * * *